US006369783B1

(12) United States Patent
Kwon et al.

(10) Patent No.: US 6,369,783 B1
(45) Date of Patent: Apr. 9, 2002

(54) CELL DRIVING APPARATUS OF A FIELD EMISSION DISPLAY

(75) Inventors: Oh Kyong Kwon; Young Sun Na, both of Seoul (KR)

(73) Assignee: Orion Electric Co., Ltd., Kyungsangbourg-do (KR)

( * ) Notice: Subject to any disclaimer, the term of this patent is extended or adjusted under 35 U.S.C. 154(b) by 0 days.

(21) Appl. No.: 09/269,213

(22) PCT Filed: Jan. 30, 1998

(86) PCT No.: PCT/KR98/00019

§ 371 Date: May 11, 1999

§ 102(e) Date: May 11, 1999

(87) PCT Pub. No.: WO99/05667

PCT Pub. Date: Feb. 4, 1999

(30) Foreign Application Priority Data

Jul. 25, 1997 (KR) ..... 97-35023
Nov. 29, 1997 (KR) ..... 97-64907

(51) Int. Cl.[7] ..... G09G 3/22

(52) U.S. Cl. ..... 345/75.2; 345/74.1; 345/204; 315/169.1; 315/169.3

(58) Field of Search ..... 345/74.1, 75.2, 345/204; 315/169.1, 169.3, 167; 313/336

(56) References Cited

U.S. PATENT DOCUMENTS 5,103,145 A 4/1992 Doran ..... 315/381
5,157,309 A 10/1992 Parker et al. ..... 315/169.1
5,210,472 A 5/1993 Casper et al. ..... 315/169.1
5,300,862 A 4/1994 Parker et al. ..... 315/169.1
5,457,356 A 10/1995 Parodos ..... 313/505
5,644,195 A 7/1997 Browning ..... 315/169.3
5,786,795 A 7/1998 Kishino et al. ..... 345/75
5,847,515 A 12/1998 Lee et al. ..... 315/169.1
6,097,359 A * 8/2000 Kwon et al. ..... 345/211

FOREIGN PATENT DOCUMENTS

FR 2707032 12/1994
KR 97-30113 6/1997
WO WO 97/22134 6/1997

* cited by examiner

*Primary Examiner*—Lun-Yi Lao
(74) *Attorney, Agent, or Firm*—Merchant & Gould PC

(57) ABSTRACT

The present invention generates a cell driving apparatus of a field emission display capable of increasing a grey level and minimizing an area problem by designing a current mode DAC which contains low voltage devices. The cell driving apparatus for use in the field emission display employing a passive matrix indication method, wherein the field emission display includes a field emission device cell having a cathode and a gate electrode, and a data driving means outputting digital signals provided from the outside as data signals, comprises a current mode DAC means for providing a current to the cathode in response to the data signals from the data driving means, and a high voltage isolating means, connected between the current mode DAC means and a cathode line, for preventing an instantaneous high voltage from being provided to the current mode DAC means to thereby protect the current mode DAC means, wherein the instantaneous high voltage is generated between a gate line and the cathode line in response to a gate control signal derived from a gate control means. By using the cell driving apparatus, the present invention obtains a current source having an improved voltage-to-current characteristic to thereby advance the grey level.

12 Claims, 4 Drawing Sheets

CELL DRIVING APPARATUS OF A FIELD EMISSION DISPLAY

FIELD OF THE INVENTION

The present invention relates to a field emission display (referred to as "FED" hereinafter); and, more particularly, to a cell driving apparatus for achieving an advanced gray scale by adjusting an amount of current provided to a cathode.

DESCRIPTION OF THE PRIOR ART

Recently, a liquid crystal display (referred to as "LCD" hereinafter), which displays pictures by selectively intercepting optical beams emitted from an optical source, has been in the limelight as one of flat panel displays. The LCD is operated by two methods one of which is a passive matrix method and the other an active matrix method.

The passive matrix method stores image data on a pixel, which is defined by an intersection of two selected electrodes, by applying different voltages at an upper plate and a lower plate of the LCD, respectively. In case the LCD employs the passive matrix method, a compensation circuit is needed in order to improve image quality since one pixel can affect its surrounding pixels. As a result, a cell driving circuit of the LCD becomes complicated.

On the other hand, by employing the active matrix method, each pixel, having a cell transistor and a capacitor therein, in the LCD stores previous data until next data is inputted thereto. Accordingly, the image quality of the LCD can be improved and also the cell driving circuit can be simplified.

However, although the active matrix method can achieve an improved image quality and a simplicity of the cell driving circuit, there are drawbacks such as that a manufacturing process of the LCD becomes complex and that its productivity is decreased since a substantial amount of transistors and capacitors should be deposited on a crystal substrate of the LCD.

The LCD suffers from high power consumption since only part of light from the power is actually used in displaying the pictures. It is also difficult to generate the LCD of a large size. Furthermore, since the LCD uses tiny, sealed capsules which contain transparent liquid crystals, it has limitations such as sensitivity to temperature change in surrounding environment, weakness to pressure, and a low resolution.

To overcome the above drawbacks, a field emission display (FED) is proposed. The FED displays pictures in a similar manner used in a cathode-ray tube (CRT) which displays the pictures by using emitted electrons. However, the FED uses a cold electron emission unlike the CRT which uses a thermal electron emission.

The FED sets up for each pixel a field emission device which emits electrons and displays the pictures by using electrons which collide with an electrode having a fluorescent plate deposited thereon. Recently, such FED is in the limelight as a next generation flat panel display capable of overcoming the drawbacks of the LCD mentioned above.

The FED can integrate hundreds or thousands of field emission devices in order to produce one pixel. Referring to FIG. 1, each of the field emission devices constituting the pixel of the FED comprises a cathode 12 connected to a cathode electrode 10, a gate electrode 14 deposited on the cathode 12, and an anode 18 having a fluorescent plate 16 deposited on the back of the anode 18.

In the above, the fluorescent plate 16 generates a light corresponding to an amount of electrons colliding thereon so as to display the pictures.

The anode pulls the electrons emitted from the cathode 12 and is transparent thereby making it possible transmit the light through the fluorescent plate 16.

The cathode 12 has a conic structure as shown in FIG. 1 and emits electrons from its cone by an operating voltage derived from the cathode electrode 10.

The gate electrode 14 induces the emission of electrons from the cathode 12 by using a high-voltage which is less than a voltage provided to the anode 18 and the emitted electrons are directed to the cathode 12 having a higher voltage.

A cell driving method of the FED containing the above field emission devices can be a passive matrix method or an active matrix method. They, i.e., the two matrix methods are similar to those used in the LCD.

The passive matrix method generally drives a cell by using a difference between a gate voltage Vg provided to a gate line and a cathode voltage Vk applied to a cathode line. By using the above passive matrix method, full color can be readily achieved. However, since a rate of current-to-voltage of tips is non-linear and the tips are not uniformly deposited, it is difficult to control a level of current.

Although the passive matrix method outputs the cathode voltage Vk as a pulse pattern with a predetermined number of pulses while the gate voltage Vg is maintained at a high level thereby representing a gray level by using the number of pulses, it has a disadvantage of having a limitation in representing the gray scale.

Meanwhile, as the active matrix method, a method, which is described in U.S. Pat. No. 5,210,472, is noticed. By driving a cell by using the active matrix method disclosed in the above patent, there are advantages of minimizing crosstalk and addressing with a lower voltage.

According to the cell driving performed by the active matrix method, the gray scale is represented by a pulse width modulation (PWM), and, thus, it is difficult to achieve full color. Also, a transistor should be integrated on each cell and, thereafter, there exists a complexity in manufacturing processes and a high cost.

Therefore, in order to overcome the above disadvantages, a cell driving apparatus of a FED had been proposed(see Korean patent application NO. 95-45457). The cell driving apparatus employs the passive indication method to avoid the complexity of manufacturing processes and achieves an appropriate gray scale by controlling an amount of current provided to a cathode.

The FED disclosed in the above Korean patent application includes a field emission pixel, which contains a cathode and a gate electrode emitting electrons from the cathode, and employs the passive matrix indication method. The cell driving apparatus for use in the FED comprises more than one current source deposited so as to supply a constant current signal to the cathode and a controller selectively operating two or more current sources which generate different amounts of current signals according to the size of a video signal.

The cell driving apparatus of the FED disclosed in the Korean patent application NO. 95-45457 provides various current signals to the cathode by selectively operating two or more current sources according to the size of the video signal to thereby linearly adjust the amount of electrons to be emitted from the cathode. In result, the cell operating apparatus solved the drawbacks due to the lack of uniformity of the tips and the limitation in obtaining the full color.

In the meanwhile, in the cell driving apparatus of the FED disclosed in the Korean patent application NO. 95-45457, high voltage devices were used in designing a current mode DAC such as a current mirror 18, a current valve 20, and a current source 21 which supplies a constant current to the cathode of the FED. The current mode DAC was designed to prevent a high voltage from being instantaneously applied to the cathode, wherein the instantaneous high voltage is due to parasitic capacitance existing on the gate line and the cathode line.

However, since the high voltage MOS device has a lengthily extended drain structure capable of precluding the instantaneous high voltage compared with a low voltage device, it occupies a wide area.

In addition to this, the usage of the high voltage MOS device occupying the wide area can induce a problem when enhancing a gray level represented by a pixel in the FED by minutely dividing a current level which is provided to the cathode since, in order to generate the current having a various level, the current mode DAC should increase the number of components devices thereof.

SUMMARY OF THE INVENTION

It is, therefore, a primary object of the present invention to provide a cell driving apparatus of a FED capable of increasing a gray level and minimizing an area problem by designing a current mode DAC which contains low voltage devices.

In accordance with one aspect of the present invention, there is provided a cell driving apparatus for use in a field emission display employing a passive matrix indication method, wherein the field emission display includes a field emission device cell having a cathode and a gate electrode, and a data driving unit outputting digital signals provided from the outside as data signals, comprising: a current mode DAC unit for providing a current to the cathode in response to the data signals from the data driving unit; and a high voltage isolating unit, connected between the current mode DAC unit and a cathode line, for preventing an instantaneous high voltage from being provided to the current mode DAC unit to thereby protect the current mode DAC unit, wherein the instantaneous high voltage is generated between a gate line and the cathode line in response to a gate control signal derived from a gate control unit.

In accordance with another aspect of the present invention, there is provided the cell driving apparatus for use in the FED further comprising a float-preventing unit for precluding the high voltage isolating unit from being floated when the instantaneous high voltage is supplied to the cathode line.

BRIEF DESCRIPTION OF THE DRAWINGS

The foregoing and other objects, features and advantages of the present invention will become apparent from the following detailed description of preferred embodiments of the invention with reference to the accompanying drawings, in which.

DETAILED DESCRIPTION OF THE PREFERRED EMBODIMENTS

The embodiments of the present invention will be illustrated in detail with reference to the accompanying drawings.

Figure 1:
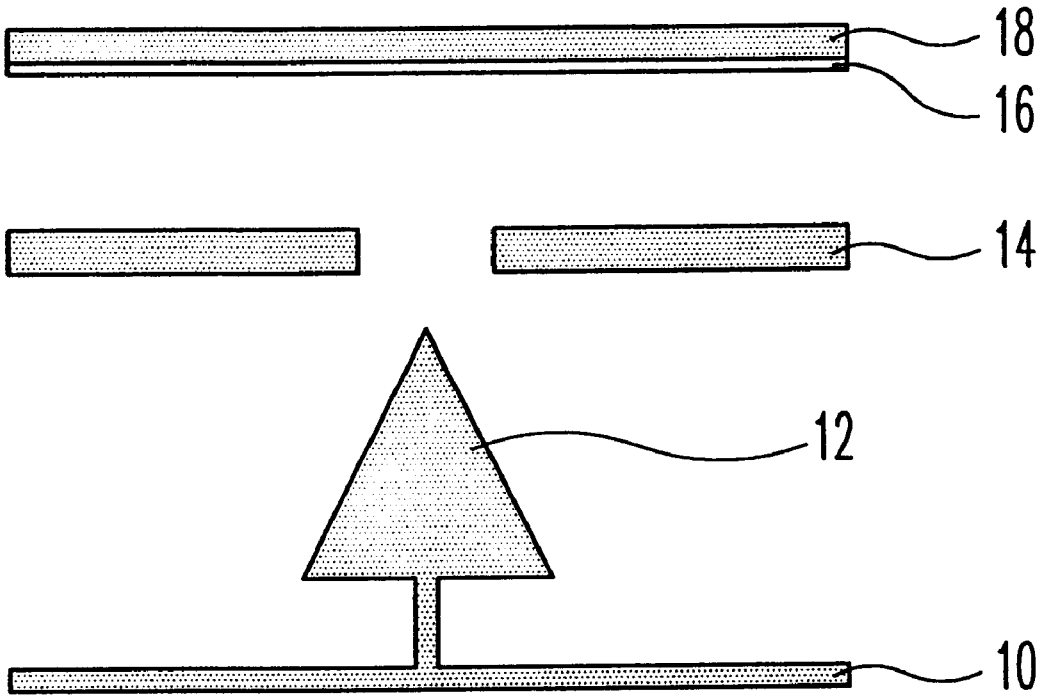
Fig . 1 (Prior Art)
FIG. 1 represents a structure of a conventional field emission display.
Figure 2:
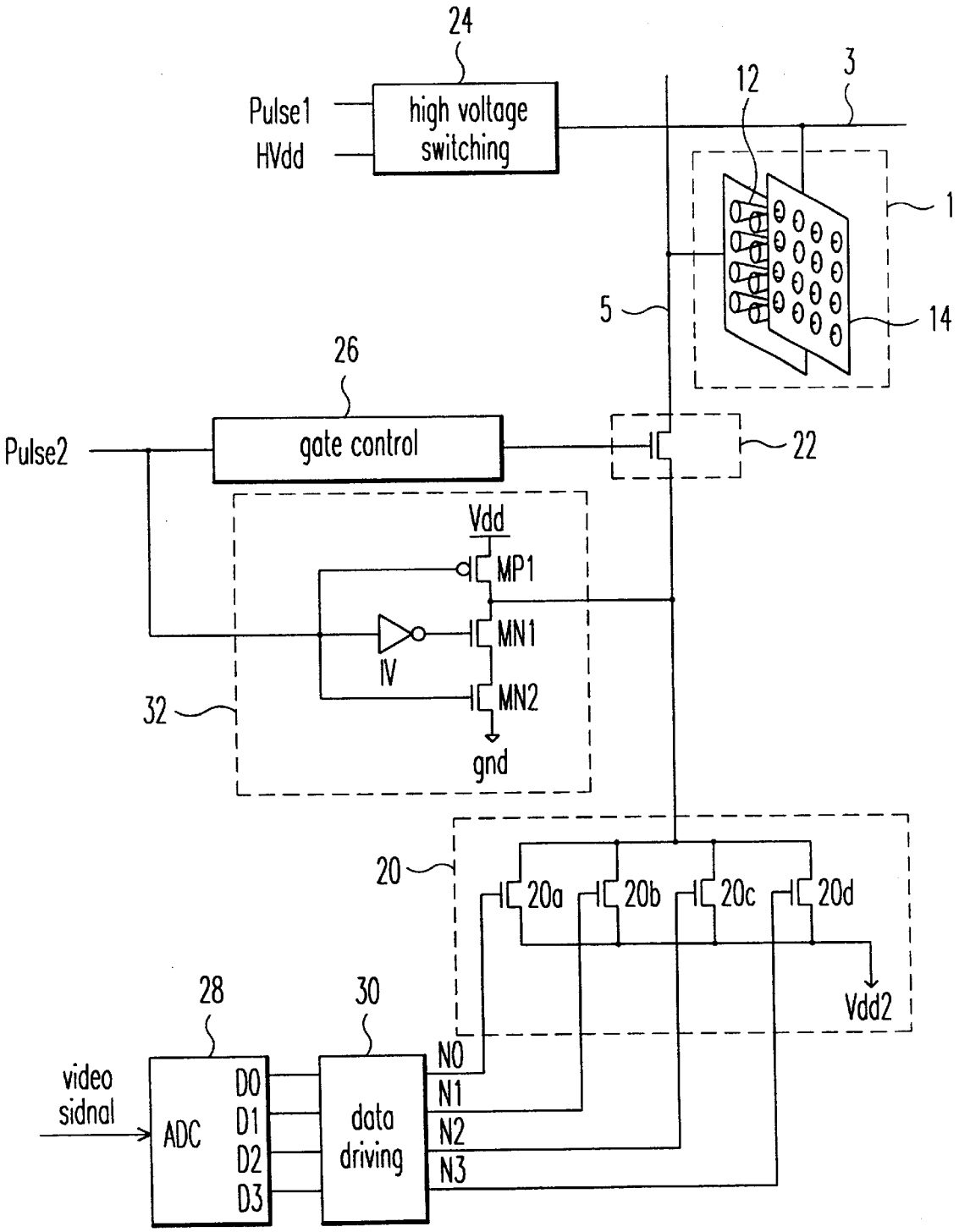
FIG. 2 shows a cell driving apparatus of a field emission display in accordance with a first embodiment of the present invention.

Referring to FIG. 2, there is represented a cell driving apparatus of a FED in accordance with a first embodiment of the present invention. As shown in FIG. 2, the cell driving apparatus contains a high voltage isolating circuit 22 connected between a cathode line 5 of a cell 1, which basically consists of field emission devices having a gate electrode 14 and a cathode 12, and a current mode DAC unit 20 deposited between the high voltage isolating circuit 22 and a low voltage Vdd2.

As a high voltage outputted from a high voltage switching unit 24 connected to a gate line 3 is fed onto the gate line 3, the high voltage isolating circuit 22 prevents the high voltage from being instantaneously applied to the cathode line 5 by a parasitic capacitance existing on the gate line 3 and the cathode line 5. It is preferable that the high voltage isolating circuit 22 includes a high voltage NMOS device which has a gate connected on an output terminal of a gate control unit 26, a drain connected on the cathode line 5, and a source connected to the current mode DAC unit 20.

The high voltage switching unit 24 adaptively provides a high voltage HVdd and a ground voltage GND to the gate line 3 based on a gate scan pulse Pulse1 inputted from outside.

The gate control unit 26 operated the NMOS transistor of the high voltage isolating circuit 22 based on a control signal Pulse2 derived from a controller (not shown).

The current mode DAC unit 20 supplies current to the cathode 12 based on data signals N0, N1, N2, and N3 derived from a data driving unit 30, wherein the current mode DAC unit 20 consists of a multiplicity of NMOS transistors 20*a*, 20*b*, 20*c*, and 20*d* connected to one another in parallel, each of the NMOS transistors being a low voltage device. The respective data signals N0, N1, N2, N3 from the data driving unit 30 are provided to respective gates of the NMOS transistors 20*a*, 20*b*, 20*c*, and 20*d*.

The multiplicity of NMOS transistors 20*a*, 20*b*, 20*c*, and 20*d* may produce currents having identical values. However, it is more preferable that the current values generated from the NMOS transistors increase by $2^n$ multiples of the current value produced from the lowest NMOS transistor 20*a* in an order starting from the lowest NMOS transistor 20*a* to the highest NMOS transistor 20*d*, n being a positive integer. For this reason, it is preferable that the NMOS transistors 20*b*, 20*c*, and 20*d* are designed to have channel widths whose sizes are twice, four times, and eight times the channel width of the lowest NMOS transistor 20*a*, respectively.

For example, when an amount of current flowing through a source of the lowest NMOS transistor 20*a* is 100 $\mu$A, those of the NMOS transistors 20*b*, 20*c*, and 20*d* are 200 $\mu$A, 400 $\mu$A, and 800 $\mu$A, respectively.

In the meantime, an analog/digital converting (ADC) unit 28 converts a video signal fed thereto into digital signals D0, D1, D2, and D3 and provides them to the data driving unit 30. The data driving unit 30 provides the digital signals D0, D1, D2, and D3 to the current mode DAC unit 20 as the data signals N0, N1, N2, and N3.

In FIG. 2, a float-preventing circuit 32 is equipped between the source of the NMOS transistor constituting the high voltage isolating circuit 22 and an input terminal of the gate control unit 26 to preclude the source of the high voltage isolating circuit 22 from being floated when a high voltage is supplied to the cathode line 5.

The float-preventing circuit 32 contains a first to a third MOS devices MP1, MN1, and MN2. The first MOS device MP1 is a PMOS transistor whose gate and source are connected to the input terminal of the gate control unit 26 and a voltage source Vdd, respectively, and whose drain is used as an output terminal of the float-preventing circuit 32. The second MOS device MN1 employs an NMOS transistor whose gate is joined with the input terminal of the gate control unit 26 via an inverter IV included in the float-preventing circuit 32 and whose drain is connected with the drain of the first MOS device MP1. The third MOS device MN2 contains an NMOS transistor which is deposited between the source of the second MOS device MN1 and the ground voltage source GND and whose gate is connected with the input terminal of the gate control unit 26.

The source voltage Vdd provided to the float-preventing circuit 32 has an identical level to a high level of the control signal generated from the controller.

The operation of the float-preventing circuit 32 will be explained hereinafter. When the high voltage is fed to the cathode line 5 and the control signal Pulse2 derived from the controller has a low level, the first and second MOS devices MP1 and MN1 in the float-preventing circuit 32 are turned on and the third MOS device MN2 is turned off. Thereafter, the source voltage Vdd is supplied to the source of the NMOS transistor in the high voltage isolating circuit 22. As a result of the above operation, a voltage level at the source of the NMOS transistor in the high voltage isolating circuit 22 is not up to a higher level than Vdd and, accordingly, the current mode DAC unit 20 having low voltage devices is protected from a higher voltage.

On the other hand, if the control signal Pulse2 has a high level, the first and the second MOS devices MP1 and MN1 are turned off and, thereafter, the float-preventing circuit 32 does not perform its operation any more.

Figure 3:
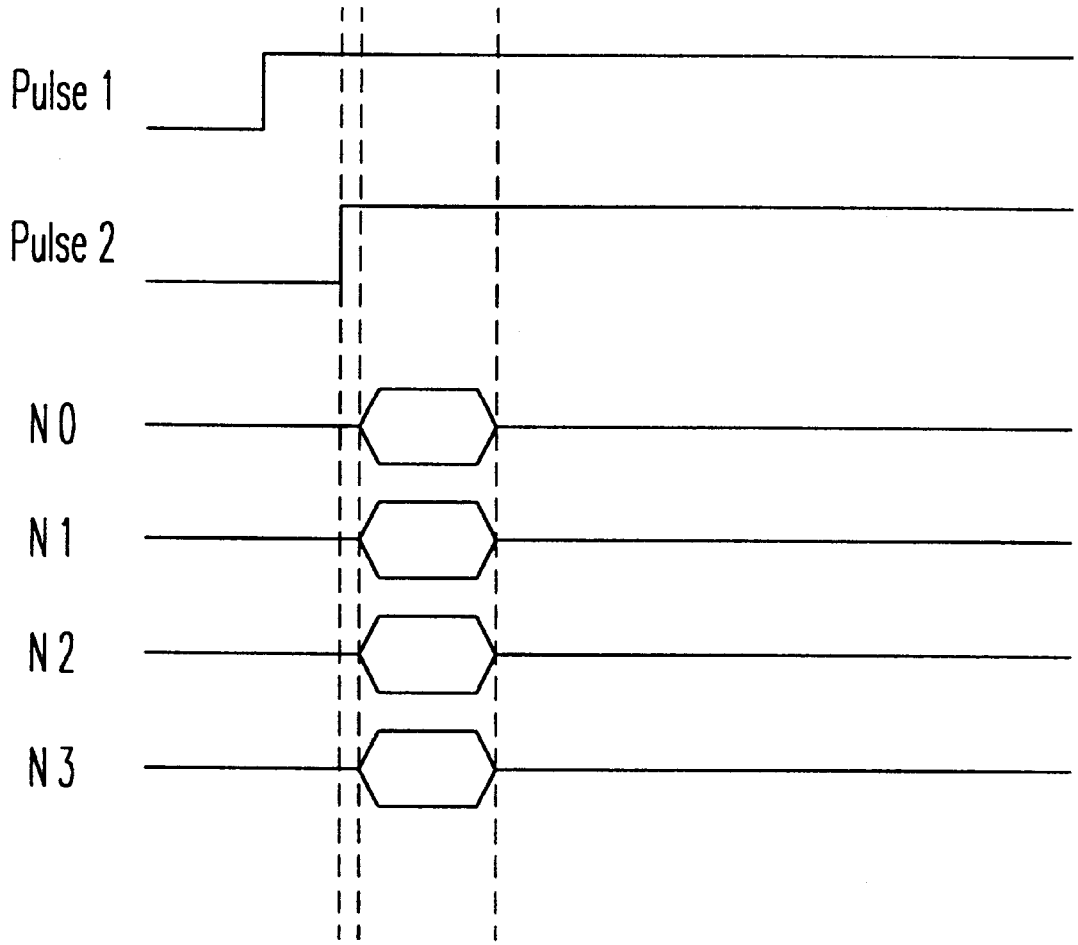
FIG. 3 is a timing diagram of signals used in the cell driving apparatus in FIG. 2.

Referring to FIG. 3, there is shown a timing diagram of the data signals N0, N1, N2, and N3 and the pulse signals Pulse1 and Pulse2 used in the cell driving apparatus in FIG. 2. First of all, the gate scan pulse Pulse1, which is coupled to the high voltage switching unit 24, is changed to a high level and, after a little time, the control signal Pulse2, which is fed to the gate control unit 26, is changed to a high level. Pulse2 is changed to a low level during the high level of the Pulse1

Then, the outputs of the data driving unit 30, i.e., the data signals N0, N1, N2, and N3 are provided to the current mode DAC unit 20 in parallel.

Figure 4:
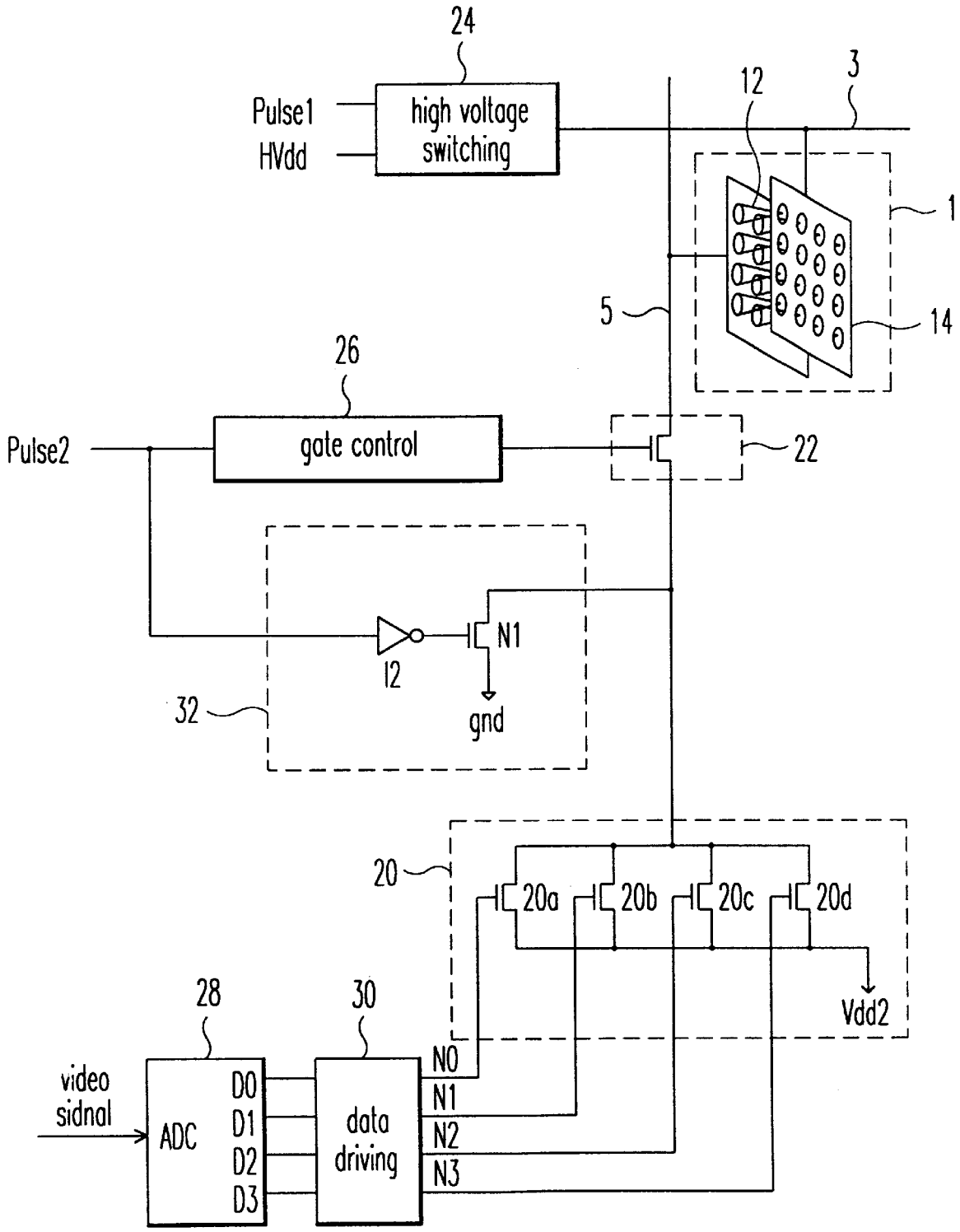
FIG. 4 depicts a cell driving apparatus of the field emission display in accordance with a second embodiment of the present invention.

FIG. 4 shows a cell driving apparatus of a FED in accordance with a second embodiment of the present invention. In FIG. 4, the units having the same numerals as in the first embodiment in FIG. 2 are identical to those in the first embodiment. Therefore, descriptions of the operations of the units are omitted for matter of simplicity.

Among the components of the second embodiment in FIG. 4, only the float-preventing circuit is different from that in FIG. 2.

That is, the float-preventing circuit 32 in FIG. 4 contains an inverter I2 for level-converting the control signal Pulse2 generated from the controller (not shown) and a NMOS transistor N1 which is connected between the source of the NMOS transistor in the high voltage isolating circuit 22 and the ground voltage source GND. The gate of the NMOS transistor N1 is controlled by the output of the inverter I2.

The operation of the float-preventing circuit 32 will be described hereinbelow. If the control signal Pulse2 with a low level is inputted to the inverter I2 from the controller, the output of the inverter I2 becomes a high level and, then, the NMOS transistor N1 is turned on to thereby provide the ground voltage to a node x, i.e., the source of the NMOS transistor in the high voltage isolating circuit 22.

Accordingly, when the high voltage is supplied to the cathode line 5, the source of the NMOS transistor constituting the high voltage isolating circuit 22 maintains the ground voltage so that it can protect the current mode DAC unit 20 consisting of low voltage devices.

Subsequently, if the control signal Pulse2 is changed to a high level, the output of the inverter I2 becomes a low level. As a result, the NMOS transistor N1 is turned off and the float-preventing operation is not performed any more. In this case, the voltage provided to the node x is determined by the current-to-voltage characteristics of the current mode DAC unit 20 and the FED.

Hereinafter, the operation of the cell driving apparatus of the FED in accordance with the first embodiment of the present invention will be illustrated.

First of all, as the gate scan pulse Pulse1 having a high level is fed to the high voltage switching unit 24, the high voltage is provided to the gate line 3. At this time, an instantaneous high voltage may be coupled to the cathode line 5 by a parasitic capacitance existing between the gate line 3 and the cathode line 5 and, thereafter, the devices connected to the cathode line 5 may be broken. However, the devices connected to the cathode line 5 can be protected from the high voltage by the float-preventing operation of the float-preventing circuit 32.

After this, as the control signal Pulse2 with a high level is fed to the gate control unit 26, the NMOS transistor constituting the high voltage isolating circuit 22 is turned on and, thus, the float-preventing operation is finished.

As illustrated above, when the NMOS transistor of the high voltage isolating circuit 22 is turned on, the current mode DAC unit 20 makes a current path between the cathode 12 and the low voltage source VDD2 under the control of the data signals N0, N1, N2, and N3 derived from the data driving unit 30.

For instance, in case the data signals N0, N1, N2, and N3 of 4 bits are 1, 0, 0, and 0, respectively, only the NMOS transistor 20*a* is turned on so that the current path going through the NMOS transistor of the high voltage isolating circuit 22 and the NMOS transistor 20*a* is formed between the cathode 12 and the low voltage source Vdd2. At that time, the current value fed to the cathode 12 becames about 100 $\mu$A.

Meanwhile, when the data signals N0, N1, N2, and N3 of 4 bits are 0, 1, 0, and 0, respectively, only the NMOS transistor 20*b* is turned on so that the current path passing through the NMOS transistor of the high voltage isolating circuit 22 and the NMOS transistor 20*b* is formed between the cathode 12 and the low voltage source Vdd2. Therefore, the current value of nearly 200 $\mu$Ais supplied to the cathode 12.

In the event that the data signals N0, N1, N2, and N3 of 4 bits are 0, 0, 1, and 0, respectively, only the NMOS transistor 20*c* is turned on so that the current path going through the NMOS transistor of the high voltage isolating circuit 22 and the NMOS transistor 20*c* is formed between the cathode 12 and the low voltage source Vdd2. Accordingly, the current value of about 400 $\mu$A is provided to the cathode 12.

On the other hand, in case the data signals N0, N1, N2, and N3 of 4 bits are 0, 0, 0, and 1, respectively, only the NMOS transistor 20*d* is turned on so that the current path passing through the NMOS transistor of the high voltage isolating circuit 22 and the NMOS transistor 20*d* is formed between the cathode 12 and the low voltage source Vdd2. Therefore, the current value supplied to the cathode 12 becomes nearly 800 μA.

Finally, when the data signals N0, N1, N2, and N3 or 4 bits are 1, 1, 1, and 1, respectively, all the NMOS transistors 20*a*, 20*b*, 20*c*, and 20*d* are turned on so that the current path going through the NMOS transistor of the high voltage isolating circuit 22 and the NMOS transistors 20*a*, 20*b*, 20*c*, and 20*d* is formed between the cathode 12 and the low voltage source Vdd2. Accordingly, the current value supplied to the cathode 12 becomes about 1.5 mA. However, the above-mentioned values such as 100 μA, 200 μA, 400 μA, 800 μA, and 1.5 mA provide only to elucidate the current path between the cathode and the low voltage source.

In the meantime, when the data signals N0, N1, N2, and N3 having a different data combination from the above examples are coupled to the NMOS transistors 20*a*, 20*b*, 20*c*, and 20*d*, the operations of the devices become similar to the above examples.

As can be seen above, if an established amount of current is supplied to the cathode 12 while the high voltage is being provided to the gate line 3, the established amount of electrons is emitted from the corn of the cathode 12. The emitted electrons are accelerated by the anode 18 and, then, are collided with the fluorescent plate 16 to thereby generate the light.

The operation of the cell driving apparatus in accordance with the second embodiment of the present invention is accomplished in the same manner as the first embodiment. Therefore, the explanation of the operation of the second embodiment is omitted.

In accordance with the present invention as illustrated above, by using low voltage devices instead of high voltage devices, when a high voltage is provided to the gate line in an initial state, a voltage-to-current characteristic in a saturation region is extraordinarily better than in cases of using the high voltage devices and, thereafter, an ideal current source can be obtained. As a result, a more accurate gray level can be produced.

Furthermore, in achieving a various gray level, a DAC with the low voltage devices can be less limited by area compared to a DAC containing the high voltage devices and, it can be easy to control currents having a low level by using the low voltage devices.

In the above embodiments of the present invention, the case of providing a pixel with a gray scale of 16 levels is explained. However, the present invention can be applied to supplying a pixel with a gray scale of 32, 64, or 124 levels.

In addition to this, similar to a γ correction in a CRT, in the embodiments described above, the brightness of pictures can be adjusted by controlling the voltage corresponding to the data signals N0, N1, N2, and N3 which are inputted from the data driving unit 30 to the current mode DAC unit 20. While the present invention has been described with respect to the particular embodiments, it will be apparent to those skilled in the art that various changes and modifications may be made without departing from the spirit and scope of the invention as defined in the following claims.

What is claimed is:

1. A cell driving apparatus for use in a field emission display employing a passive matrix indication method, wherein the field emission display includes a field emission device cell having a cathode and a gate electrode, and a data driving means outputting digital signals provided from the outside as data signals, comprising:

a current mode DAC means for providing a current to the cathode in response to the data signals from the data driving means; and a high voltage isolating means, connected between the current mode DAC means and a cathode line, for preventing an instantaneous high voltage from being provided to the current mode DAC means to thereby protect the current mode DAC means, wherein the instantaneous high voltage is generated between a gate line and the cathode line in response to a gate control signal derived from a gate control means.

2. The cell driving apparatus as recited in claim 1, wherein the current mode DAC means includes a multiplicity of low voltage NMOS transistors which are connected in parallel with each other.

3. The cell driving apparatus as recited in claim 2, wherein, among the multiplicity of NMOS transistors, compared with the channel width of the lowest NMOS transistor, that of its following NMOS transistor is adjusted to have a current value which increases by $2^n$ multiples of the current value produced from the lowest NMOS transistor in response to a same gate voltage provided to the NMOS transistors, n being zero or a positive integer.

4. The cell driving apparatus as recited in claim 1, wherein the high voltage isolating means includes a high voltage MOS device.

5. The cell driving apparatus as recited in claim 4, wherein the high voltage MOS device is an NMOS transistor.

6. The cell driving apparatus as recited in claim 1, the gate control signal is provided to the high voltage isolating means prior to data signals which are coupled to the current mode DAC means.

7. The cell driving apparatus as recited in claim 1 further comprising a float-preventing means for precluding the high voltage isolating means from being floated when the instantaneous high voltage is supplied to the cathode line.

8. The cell driving apparatus as recited in claim 7, wherein the float-preventing means includes:

a first MOS device connected between an input terminal of the gate control means and an output terminal of the high voltage isolating means;

a second MOS device connected with the first MOS device in series and having one part joined to the input terminal of the gate control means via an inverter; and a third MOS device connected with the second MOS device in series and having one part joined to the input terminal of the gate control means.

9. The cell driving apparatus as recited in claim 8, wherein the first MOS device is a PMOS transistor.

10. The cell driving apparatus as recited in claim 8, wherein the second and the third MOS devices are NMOS transistors, respectively.

11. The cell driving apparatus as recited in claim 7, wherein the float-preventing means includes:

an inverter, connected to the input terminal of the gate control means, for inverting a control signal produced from a control means; and a MOS device connected between the high voltage isolating means and a ground source and on/off switched responsive to an output of the inverter.

12. The cell driving apparatus as recited in claim 11, wherein the MOS device is an NMOS transistor.

* * * * *